US005355959A

United States Patent [19]

Walter et al.

[11] Patent Number: 5,355,959

[45] Date of Patent: Oct. 18, 1994

[54] DIFFERENTIAL PRESSURE OPERATED CIRCULATING AND DEFLATION VALVE

[75] Inventors: Jeffrey S. Walter; James C. Tucker; John C. Zimmerman, all of Duncan, Okla.

[73] Assignee: Halliburton Company, Duncan, Okla.

[21] Appl. No.: 949,303

[22] Filed: Sep. 22, 1992

[51] Int. Cl.[5] ..... E21B 34/08

[52] U.S. Cl. ..... 166/321

[58] Field of Search ..... 166/51, 72, 162, 264, 166/278, 317, 319, 321, 323, 373, 374, 387

[56] References Cited

U.S. PATENT DOCUMENTS

| | | | |
|---|---|---|---|
| 3,130,789 | 4/1964 | Alexander et al. | 166/317 |
| 3,850,250 | 11/1974 | Holden et al. | 166/315 |
| 3,930,540 | 1/1976 | Holden et al. | 166/315 |
| 3,970,147 | 7/1976 | Jessup et al. | 166/250 |
| 4,044,829 | 8/1977 | Jessup et al. | 166/264 |
| 4,058,165 | 11/1977 | Holden et al. | 166/314 |
| 4,059,157 | 11/1977 | Crowe | 166/317 |
| 4,063,593 | 12/1977 | Jessup | 166/317 |
| 4,064,937 | 12/1977 | Barrington | 166/162 |
| 4,113,012 | 9/1978 | Evans et al. | 166/264 |
| 4,281,715 | 8/1981 | Farley | 166/323 |
| 4,311,197 | 1/1982 | Hushbeck | 166/373 |
| 4,324,293 | 4/1982 | Hushbeck | 166/317 |
| 4,428,428 | 1/1984 | Smyrl et al. | 166/319 |
| 4,445,571 | 5/1984 | Hushbeck | 166/317 |
| 4,603,741 | 8/1986 | Edgmon | 166/317 |
| 4,632,193 | 12/1986 | Geczy | 166/237 |
| 4,657,082 | 4/1987 | Ringgenberg | 166/336 |
| 4,691,779 | 9/1987 | McMahan et al. | 166/321 |
| 5,082,062 | 1/1992 | Wood et al. | 166/382 |
| 5,174,379 | 12/1992 | Whiteley et al. | 166/278 |

*Primary Examiner*—Ramon S. Britts
*Assistant Examiner*—Frank S. Tsay
*Attorney, Agent, or Firm*—James R. Duzan; Neal R. Kennedy

[57] ABSTRACT

A differential pressure operated valve for use as a circulating and/or deflation valve in a well bore. The valve comprises a housing defining first and second bores therethrough and a passage providing communication between the interior and exterior of the housing. A valve sleeve is slidably disposed in the housing and has a first outer surface slidably disposed in the first bore and a second outer surface slidably disposed in the second bore. A valve port is defined in the valve sleeve providing communication between a central opening thereof and the passage in the housing when the valve sleeve is in an open position. When the valve sleeve is closed, the valve port and passage are isolated from one another. The first and second outer surfaces of the valve sleeve define a differential area, and the valve is closed by fluid flow creating a differential pressure acting across this area. A spring biases the valve toward the open position. A mandrel may be disposed in the valve which has a flange thereon for locking the valve sleeve in the closed position. A mandrel port defined in the mandrel is in communication with the passage in the housing when the valve sleeve is in the open position.

27 Claims, 3 Drawing Sheets

DIFFERENTIAL PRESSURE OPERATED CIRCULATING AND DEFLATION VALVE

BACKGROUND OF THE INVENTION

1. Field Of The Invention

This invention relates to valves used in downhole well tools, and more particularly, but not by way of limitation, to a circulating valve which may be used to allow circulation of fluid through a downhole tool as it is run into a well bore on a coiled tubing. The valve may also be used as a deflation valve for inflatable packers associated with a downhole tool.

2. Description Of The Prior Art

On various types of downhole tools, for example but not by way of limitation, inflatable packers, it is often desirable to circulate fluid in the well as the tool is being run into the well bore. A number of circulating valves have been developed in the past, but most of these require manipulation, including rotation, of the tool string. Such rotation is not possible on tools run into the well bore on coiled tubing.

The present invention solves this problem by allowing circulation of fluids as the tool is run into the well. The valve is closed simply by pumping fluid through the tool so that a differential pressure closes the valve without any manipulation of the tool string being necessary.

A particular problem when inflatable packers are run into a well bore is involved in deflating the packers. Such tools are preferably run into the well bore with a check valve in the tubing string so that fluid cannot flow back upwardly through the tubing. Unfortunately, this also can prevent venting of fluids from the packer. The valve of the present invention acts as a deflation valve which may be reopened during a deflation operation so that fluids from the packer may be vented through the valve into the well annulus, thereby allowing packer to deflate.

SUMMARY OF THE INVENTION

The differential pressure operated valve of the present invention may be used as a circulating valve for circulating fluids as the tool is run into the well bore and also as a deflation valve for deflating inflatable packers or the like in the well bore. The valve generally comprises a housing means for connecting to a downhole tool, such as a tool used on coiled tubing. The housing means defines a passage therethrough between an interior and an exterior of the housing means. This passage acts as either a circulating passage or a deflation passage. The valve further comprises a valve sleeve slidably disposed in the housing means and defining a valve port therethrough in communication with the passage when in an open position and isolated from the passage when in a closed position. The valve sleeve has a differential area defined thereon, whereby the valve sleeve is movable from the open position to the closed position in response to a differential pressure acting across the area. This differential pressure is created by a fluid flow rate through restriction of ports in the valve. In the preferred embodiment, the differential area is a substantially annular area defined between first and second outer surfaces of the valve sleeve.

The housing means defines a first bore and a second bore therein. The first outer surface of the valve sleeve is received in the first bore, and the second outer surface of the valve sleeve is received in the second bore. In one preferred embodiment, the housing means comprises a valve adapter in which the first bore is defined and a valve case, attached to the valve adapter, in which the second bore is defined. The first bore is preferably larger than the second bore. The passage is disposed through a wall of the valve case. The valve adapter has a shoulder therein for limiting movement of the valve sleeve as the valve sleeve is moved toward the open position.

The valve further comprises first sealing means for sealing between the first outer surface and the first bore on a first side of the passage and the valve port, and a second sealing means for sealing between the second outer surface and the second bore on a second side of the passage from the first sealing means in the valve port. The valve may further comprise a third or intermediate sealing means for sealing between the second outer surface and the second bore, on the second side of the passage and the first side of the valve port, when the valve sleeve is in the closed position. The housing means also defines a counterbore between the first and second bores in communication with the passage. The counterbore is preferably sized such that the intermediate sealing means is spaced radially inwardly therefrom.

The valve also comprises biasing means for biasing the valve sleeve toward the open position. In one preferred embodiment, the biasing means is characterized by a spring which engages the valve sleeve and a shoulder formed in the valve case of the housing means.

The valve may further comprise mandrel means for sliding within the housing means. This mandrel means may be connected to the tool to which the housing means is attached and form a portion thereof. The mandrel means defines a mandrel port therethrough which is in communication with the passage when the valve sleeve is in the open position. The mandrel port may act as either a circulating port or a deflation port. The mandrel means may further comprise fluid relief means for relieving fluid between the mandrel means and the valve sleeve as the valve sleeve is moved between the open and closed positions.

The apparatus may additionally comprise locking means for locking the valve sleeve in the closed position. In one embodiment, the locking means is characterized by a flange extending from the mandrel means. The flange is adapted for engaging the valve sleeve and holding the valve sleeve closed when the mandrel means is in a locking position.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
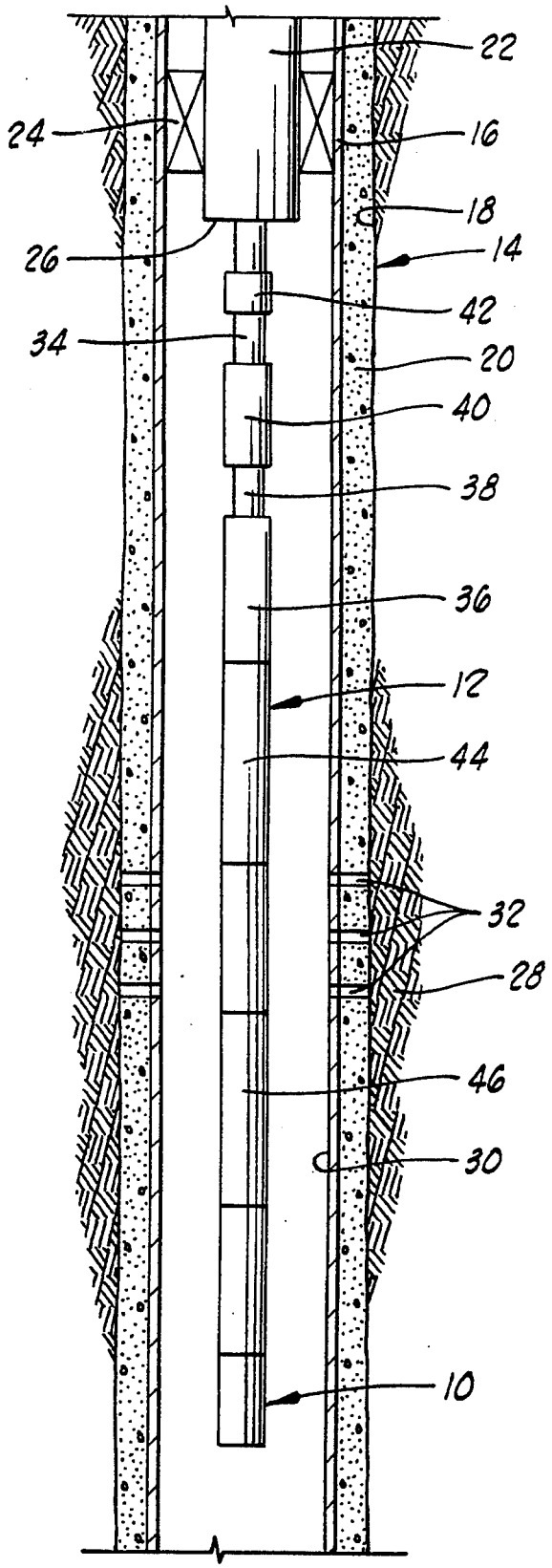
FIG. 1 is a schematic elevation view of a typical downhole tool on coiled tubing utilizing the differential pressure operated circulating and deflation valve of the present invention. The apparatus is shown lowered through a production tubing and is located in the production casing below the lower end of the production tubing.

Referring now to the drawings, and more particularly to FIG. 1, the circulating/deflation valve of the present invention is shown and generally designated by the numeral 10. Valve 10 is attached to the lower end of a downhole tool 12. The illustrated downhole tool 12 is an inflatable straddle packer apparatus, but the invention is not intended to be limited to this particular application. Tool 12 with valve 10 attached thereto is shown after it has been lowered into a well generally designated by the numeral 14. Generally, well 14 includes a production casing 16 cemented in place within a borehole 18 by cement 20. A production tubing 22 is located within casing 16 and has a packer 24 sealing the annulus between production tubing 22 and production casing 16. Production casing 16 extends downwardly below lower end 26 of production tubing 22. Well 16 intersects a subsurface formation 28, and an interior 30 of production casing 16 is communicated with the formation 26 through a plurality of perforations 32.

In FIG. 1, tool 12 has been lowered to a depth on a length of coiled tubing string 34 into position adjacent to subsurface formation 28. The "coiled tubing" 34 is a relatively flexible tubing having a diameter on the order of one and one-half inches which can be coiled on a large reel and brought to the well site, where it is uncoiled to lower tools into the well without the use of a drilling rig.

Tool 12 includes a housing generally designated by the numeral 36, and an inner mandrel 38 slidably received in the housing. A releasable connecting means 40 connects the upper end of mandrel 38, and thus connects housing 36, to coiled tubing 34 and communicates the inner bore of the coiled tubing with the interiors of mandrel 38 and housing 36.

Frequently, a check valve 42, of a kind known in the art, is connected to tubing string 34 in a location somewhere above tool 12. Check valve 42 prevents upward flow through coiled tubing 34 while allowing downward flow to tool 12. If a check valve is not used in tubing string 34, the present invention can work as a fill-up valve as the tool string is run into the well, as will be further described herein.

In the instance where tool 12 is an inflatable straddle packer 12, the tool includes upper and lower packer elements 44 and 46. These packer elements are adapted for sealingly engaging production casing 16 for operations such as treating subsurface formation 28. Again, it is not intended that valve 10 of the present invention be limited to use with an inflatable straddle packer.

Figure 2A:
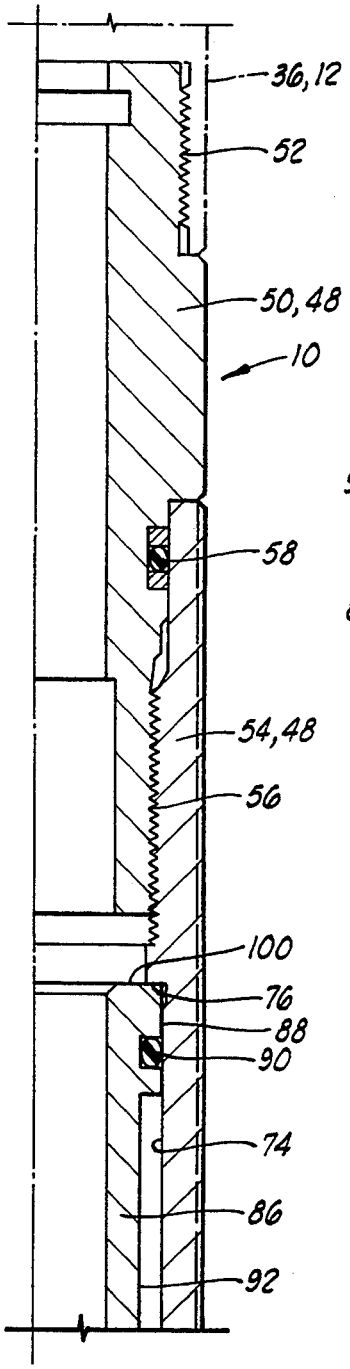
FIGS. 2A–2C comprise a right-side only sectional view of the circulating/deflation valve of the present invention.
Figure 2B:
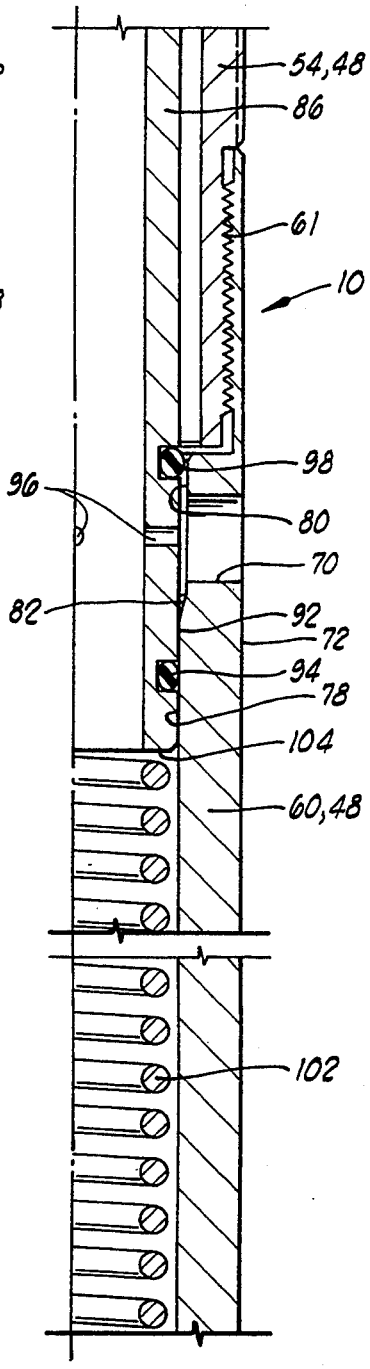
Figure 2C:
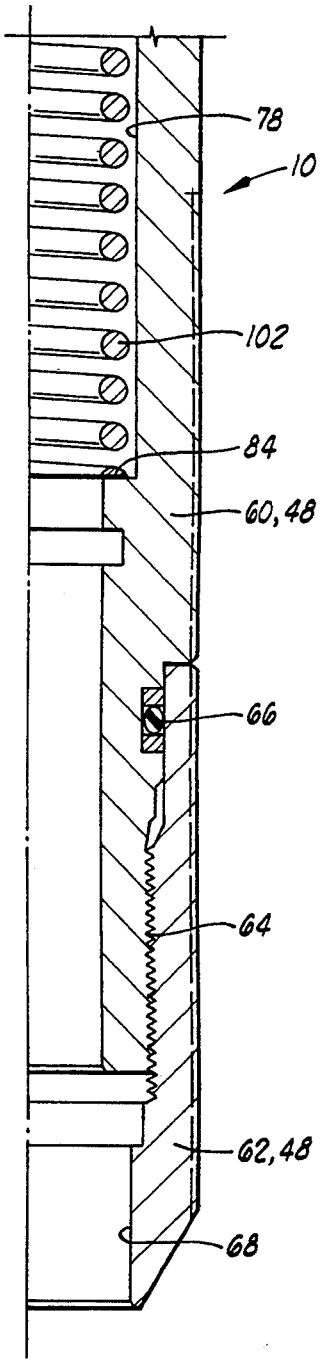

Referring now to FIGS. 2A–2C, the details of a first embodiment of circulating/deflation valve 10 will be discussed. Valve 10 comprises an outer housing means 48 which is connected to housing 36 of tool 12. More particularly, housing means 48 has at its upper end a valve connector 50 with a threaded surface 52 adapted for connection to tool 12 in a manner known in the art. The lower end of valve connector 60 is attached to a valve adapter 54 at threaded connection 56. A sealing means 58 provides sealing engagement therebetween.

Referring now to FIG. 2B, the lower end of valve adapter 54 is connected to a valve case 60 at threaded connection 61. As seen in FIG. 2C, the lower end of valve case 60 is attached to a bottom adapter 62 at threaded connection 64. A sealing means 66 may be used for providing sealing engagement therebetween. Bottom adapter 62 may have an opening 68 therethrough, but is not intended to be so limited.

Valve case 60 of housing 48 defines a plurality of housing passages 70 therethrough. Housing passages 70 communicate with an exterior 72 of housing 48. Passages 70 may also be referred to as circulating passages 70 and/or deflation passages 70.

Valve adapter 54 defines an adapter bore 74 therein. Adapter bore 74 may also be referred to as first bore 74 in housing means 48. At the upper end of first bore 74 is an inwardly extending annular shoulder 76. Valve case 60 defines a case bore 78 therein which is somewhat smaller than first bore 74 in valve adapter 54. Case bore 78 may also be referred to as a second bore 78 in housing means 48. At the upper end of second bore 78, valve case 60 defines a slightly larger counterbore 80 therein which will be seen to be in communication with passages 70. A chamfer 82 extends between counterbore 80 and second bore 78 in valve case 60. At the lower end of second bore 78 is a radially inwardly extending shoulder 84.

A valve sleeve 86 is slidably disposed in valve adapter 54 and valve case 60. The upper end of valve sleeve 86 has a first outer surface 88 which is adapted for sliding within first bore 74 of valve adapter 54. A sealing means, such as a first or upper seal 90, provides sealing between the upper end of valve sleeve 86 and valve adapter 54. Valve sleeve 86 also has a second outer surface 92 which is smaller than first outer surface 88. Second outer surface 92 is adapted to slide within second bore 78 in valve case 60. A sealing means, such as second or lower seal 94, provides sealing engagement between the lower end of valve sleeve 86 and valve case 60 below passage 70.

Valve sleeve 86 defines a plurality of valve ports 96 therethrough which are in communication with passage 70 in valve case 60 when valve sleeve 86 is in the open position illustrated in FIGS. 2A and 2B. Above valve ports 96, valve sleeve 86 carries a sealing means, such as a third or intermediate seal 98. The outside diameter of intermediate seal 98 is smaller than counterbore 80, so intermediate seal 98 is spaced radially inwardly from counterbore 80 and thus is not initially engaged with valve case 60.

Passages 70 and valve ports 96 can be jointly referred to as a circulating and/or deflation means 70, 96.

Upward movement of valve sleeve 86 is limited by engagement of upper end 100 of the valve sleeve with shoulder 76 in valve adapter 54.

A valve spring 102 is disposed in valve case 60 between lower end 104 of valve sleeve 86 and shoulder 84 in the valve case. Valve spring 102 acts as a biasing means for biasing valve sleeve 86 upwardly toward the open position and shoulder 76 in valve adapter 54.

Figures 3A, 3B, 3C:
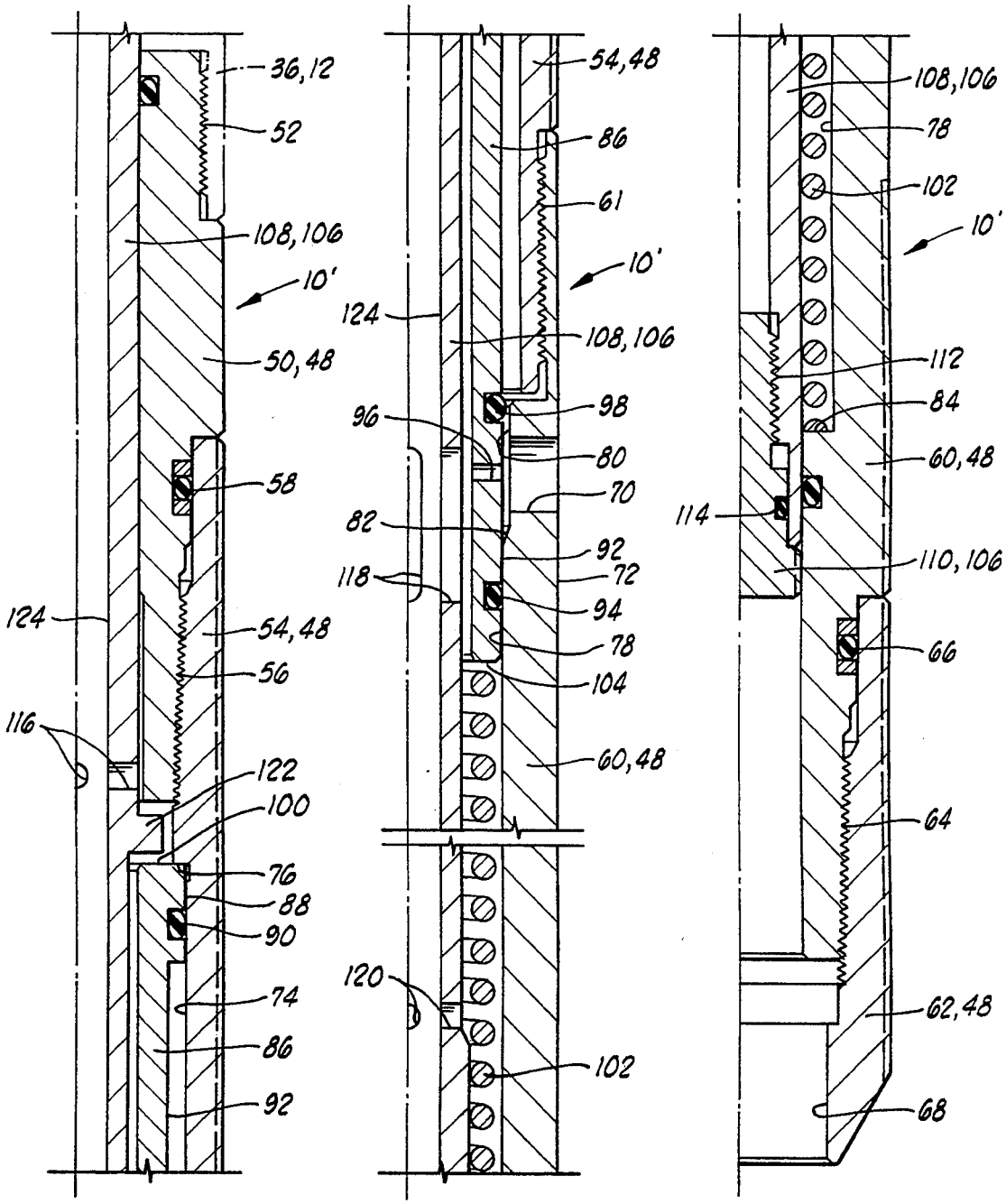
FIGS. 3A–3C show an alternate embodiment of the circulating/deflation valve.

Referring now to FIGS. 3A–3C, a second embodiment of the circulating/deflation valve of the present invention is shown and generally designated by the numeral 10'. Valve 10' has the identical housing means 48, valve sleeve 86 and valve spring 102 as first embodiment valve 10. However, second embodiment 10' also comprises an inner mandrel means 106. Mandrel means 106 includes a valve mandrel 108 which is attached at its lower end to a bottom plug 110 at threaded connection 112. A sealing means 114 provides sealing engagement therebetween.

Valve mandrel 108 defines a plurality of upper fluid relief ports 116 therethrough. Below upper fluid relief ports 116, a plurality of mandrel ports 118 are defined in valve mandrel 108. Mandrel ports 118 may also be referred to as circulating ports 118 and/or deflation ports 118. It will be seen that mandrel ports 118 are in communication with valve ports 96 in valve sleeve 86, and thus in the open position shown in FIGS. 3A and 3B, mandrel ports 118 are also in communication with passages 70 in valve case 60.

Passage ports 70, valve ports 96 and mandrel ports 118 can be jointly referred to as a circulating and/or deflation means 70, 96, 118 in second embodiment valve 10'.

Below mandrel ports 118, valve mandrel 108 defines a plurality of lower fluid relief ports 120 therethrough.

A radially outwardly extending flange 122 is formed on valve mandrel 108. Flange 122 is disposed above upper end 100 of valve sleeve 86 and below upper fluid relief ports 116 in valve mandrel 108. It will be seen, as further described herein, that as valve mandrel 108 is moved downwardly, it will engage upper end 100 of valve sleeve 86 to displace the valve sleeve downwardly.

The upper end of valve mandrel 108 is attached to mandrel 38 in tool 12 in a manner known in the art. Actually, valve mandrel 108 may be a separate component and connected to mandrel 38, such as by threaded engagement, or valve mandrel 108 may be integrally formed with mandrel 38. It is not intended that the invention be limited to any particular means of attachment of valve mandrel 108 to mandrel 38 in tool 12.

Valve mandrel 108 defines a longitudinal bore 124 therethrough which is in communication with a similar bore through mandrel 38 of tool 12 and thus in communication with the interior of coiled tubing 34.

Operation of the Invention

As tool 12 with either first embodiment valve 10 or second embodiment valve 10' attached thereto are run into well 14, fluid may be circulated down through coiled tubing 34 and mandrel 38 of tool 12. In first embodiment valve 10, fluid then flows out through valve ports 96 and circulating passages 70. Thus, in the first embodiment, circulating means 70, 96 allows circulating of fluid through tool 12 and valve 10 as they are being positioned in well 14. In second embodiment valve 10', the fluid flows downwardly through bore 124 in valve mandrel 108 and out circulating ports 118, valve ports 96 and circulating passages 70 into the well annulus. Thus, in second embodiment valve 10', circulating means 70, 96, 118 allows circulating of fluid through tool 12 and valve 10' as they are being positioned in well 14.

If tool 12 is run into well 14 without check valve 42, valve 10 or 10' may act as a fill-up valve. That is, fluid may flow inwardly through circulating passages 70 and valve ports 96 in first embodiment valve 10 or through circulating passages 70, valve ports 96 and circulating ports 118 in second embodiment valve 10' thus allowing fluid to enter tool 12. Thus, the valve of the present invention may be referred to as a fill-up valve 10 with fill-up means 70, 96 or a fill-up valve 10' with fill-up means 70, 96, 118.

After tool 12 and valve 10 or 10' have been positioned as illustrated in FIG. 1, fluid may be pumped down coiled tubing 34 to close valve 10 or 10'. Fluid pumped down coiled tubing 34 will initially flow through circulating means 70, 96 or first embodiment valve 10 or circulating means 70, 96, 118 of second embodiment valve 10' into the well annulus, as previously discussed. However, as more fluid is pumped, the fluid flow causes a pressure differential which acts across the differential area between first outer Surface 88 and second outer surface 92 on valve sleeve 86, thus causing the valve sleeve to be moved downwardly and to overcome the force of valve spring 102, compressing it.

In second embodiment valve 10', at least some of the fluid below valve sleeve 86 will be displaced through lower fluid relief ports 120 so that no pressure build-up occurs.

Intermediate seal 98 will come into contact with chamfer 82 and be gradually brought into sealing contact with bore 78 in valve case 60, thus isolating valve ports 96 from passages 70. In this position, circulating/deflation valve 10 or 10' is closed. Thereafter, fluid pumped down coiled tubing 34 will no longer flow out of valve 10 or 10'. In the embodiment of tool 12 shown as an inflatable straddle packer, additional fluid pumped down may be used to inflate packer elements 44 and 46.

In second embodiment valve 10' valve sleeve 86 may be locked or held in its closed position by downward movement of inner mandrel 106. That is, inner mandrel 106 may be lowered so that flange 122 on valve mandrel 108 engages upper end 100 of valve sleeve 86, thus physically holding it in the closed position. In this way, a locking means is provided for locking or holding valve 10' in the closed position regardless of the pressure differential between the interior of valve 10' and the well annulus.

In first embodiment valve 10, when the pressure differential is relieved, it will be seen that valve spring 102 will return valve sleeve 86 back up to its open position.

In second embodiment valve 10', inner mandrel 106 must be raised before valve sleeve 86 will reopen. Assuming that the pressure differential has been relieved raising inner mandrel 106 will cause flange 122 to be lifted above valve sleeve 86 so that spring 102 will return valve sleeve 86 back to its open position. In second embodiment valve 10', at least some of the fluid above valve sleeve 86 will be discharged through upper fluid relief ports 116 so that no pressure build-up occurs.

In the embodiment of tool 12 which is an inflatable packer, it will be seen that once circulating/deflation valve 10 or 10' is returned to its open position, fluid may be bled out of the inflatable packer through deflation means 70, 96 or 70, 96, 118 into the well annulus. Thus, the inflatable packer element or elements may be deflated even though check valve 42 is disposed above tool 12 and prevents upper fluid flow therethrough.

After all of the desired operations of tool 12 and valve 10 or 10' have been carried out, it will be seen that tool 12 and valve 10 or 10' may be moved to any other desired location within the well and additional operations carried out.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A valve comprising:

a housing means for connecting to a downhole tool and defining a passage therethrough between an interior and an exterior of said housing means, said housing means defining a first bore and a second bore therein;

a valve sleeve slidably disposed in said housing means and defining a valve port therethrough in communication with said passage when in an open position and isolated from said passage when in a closed position, said valve sleeve having a differential area thereon defined between a first outer surface and a second outer surface of said valve sleeve, wherein:

said first outer surface of said valve sleeve is received in said first bore of said housing means;

said second outer surface of said valve sleeve is received in said second bore of said housing means; and said valve sleeve is moveable from said open to said closed position in response to pressure acting across said area;

first sealing means for continuously sealing between said first outer surface and said first bore on a first side of a passage and said valve port; and second sealing means for sealing between said second outer surface and said second bore on a second side of said passage from said first sealing means and said valve port.

2. The valve of claim 1 wherein said differential area is a substantially annular area.

3. The valve of claim 1 further comprising an intermediate sealing means for sealing between said second outer surface and said second bore, on said second side of said passage and said first side of said valve port, when said valve sleeve is in said closed position.

4. The valve of claim 3 wherein said housing means defines a counterbore between said first and second bores in communication with said passage, said counterbore being sized such that said intermediate sealing means is spaced radially inwardly therefrom.

5. The valve of claim 1 wherein said housing means comprises:

a valve adapter in which said first bore is defined; and a valve case, attached to said valve adapter, in which said second bore is defined.

6. The valve of claim 5 wherein said first bore is larger than said second bore.

7. The valve of claim 5 wherein said passage is disposed through a wall of said valve case.

8. The valve of claim 5 wherein said valve adapter has a shoulder therein for limiting movement of said valve sleeve as said valve sleeve is moved toward said open position.

9. The valve of claim 1 wherein said first bore is disposed above said second bore.

10. The valve of claim 1 further comprising biasing means for biasing said valve sleeve toward said open position.

11. The valve of claim 10 wherein said biasing means is characterized by a spring.

12. The valve of claim 11 wherein said spring engages an end of said valve sleeve and a shoulder formed in said housing means.

13. The valve of claim 1 further comprising locking means for locking said valve sleeve in said closed position.

14. A valve for use in a well bore, said valve comprising:

a housing comprising:

a valve adapter portion defining an adapter bore therethrough; and a valve case portion defining a case bore therethrough smaller than said adapter bore, said valve case portion further defining a passage through a wall thereof providing communication between said case bore and an exterior of said housing; and a valve sleeve having a first outer surface slidably disposed in said adapter bore and a second outer surface slidably disposed in said case bore, said valve sleeve defining a central opening therethrough and a valve port through a wall thereof, said valve port providing communication between said central opening and said passage when said valve sleeve is in an open position and said valve sleeve preventing communication between said central opening and said passage when in a closed position, wherein said first and second outer surfaces define a differential area on said valve sleeve such that said valve sleeve is moved from said open position to said closed position when a differential pressure is applied to said area.

15. The valve of claim 14 further comprising biasing means for biasing said valve sleeve toward said open position thereof.

16. The valve of claim 15 wherein:

said valve case portion has a shoulder therein; and said biasing means is characterized by a spring disposed between said shoulder and said valve sleeve.

17. The valve of claim 14 further comprising a mandrel reciprocably disposed in said housing and extending into said central opening of said valve sleeve, said mandrel defining a mandrel port through a wall thereof in communication with said passage when said valve sleeve is in said open position.

18. The valve of claim 17 further comprising a flange on said mandrel adapted for engaging said valve sleeve and holding said valve sleeve in said closed position.

19. The valve of claim 14 further comprising sealing means for sealing between said housing and said valve sleeve.

20. The apparatus of claim 19 wherein said sealing means comprises:

a first seal adapted for sealing between said adapter bore and said first outer surface;

a second seal disposed on one side of said valve port and adapted for sealing between said case bore and said second outer surface; and a third seal disposed on an opposite side of said valve port from said second seal and adapted for sealing between said case bore and said second outer surface when said valve sleeve is in said closed position.

21. The valve of claim 20 wherein:

said housing defines a counterbore between said first and second bores; and said third seal is spaced radially inwardly of said counterbore when said valve sleeve is in said open position.

22. The valve of claim 14 further comprising means for limiting movement of said valve sleeve as it is moved from its closed position to its open position.

23. A valve comprising:

a housing means for connecting to a downhole tool and defining a passage therethrough between an interior and an exterior of said housing means;

a mandrel means for sliding within said housing means; and a valve sleeve slidably disposed in said housing means and around said mandrel means, said valve sleeve defining a valve port therethrough in communication with said passage when in an open position and isolated from said passage when in a closed position, said valve sleeve having a differential area defined thereon, whereby said valve sleeve is movable from said open to said closed position in response to pressure acting across said area.

24. The valve of claim 23 wherein said mandrel means defines a mandrel port therethrough in communication with said passage when said valve sleeve is in said open position.

25. The valve of claim 16 wherein said mandrel means comprises locking means for locking said valve sleeve in said closed position.

26. The valve of claim 25 wherein said locking means is characterized by a flange extending from said mandrel means and adapted for engaging said valve sleeve and holding the valve sleeve closed when said mandrel means is in a locking position.

27. The valve of claim 23 wherein said mandrel means comprises fluid relief means for relieving fluid between said mandrel means and said valve sleeve as said valve sleeve is moved between said open and closed positions thereof.

* * * * *